US006416383B1

(12) United States Patent
Aigner et al.

(10) Patent No.: US 6,416,383 B1
(45) Date of Patent: Jul. 9, 2002

(54) DEVICE FOR DRESSING A GRINDSTONE TO POLISH THE RUNNING SURFACE STRUCTURE OF A SKI

(75) Inventors: Johann Aigner; Gerald Höckner, both of Ried (AT)

(73) Assignee: Wintersteiger Gesellschaft m.b.H., Ried (AT)

( * ) Notice: Subject to any disclaimer, the term of this patent is extended or adjusted under 35 U.S.C. 154(b) by 0 days.

(21) Appl. No.: 09/600,187

(22) PCT Filed: Jan. 12, 1999

(86) PCT No.: PCT/AT99/00009

§ 371 (c)(1),
(2), (4) Date: Jul. 12, 2000

(87) PCT Pub. No.: WO99/36227

PCT Pub. Date: Jul. 22, 1999

(30) Foreign Application Priority Data

Jan. 16, 1998 (AT) ..... 52/98

(51) Int. Cl.[7] ..... B24B 49/00; B24B 51/00

(52) U.S. Cl. ..... 451/5; 451/11; 451/14; 451/21; 451/72

(58) Field of Search ..... 451/5, 8, 11, 14, 451/21, 22, 56, 72

(56) References Cited

U.S. PATENT DOCUMENTS

| | | | | |
|---|---|---|---|---|
| 3,736,704 A | * | 6/1973 | Robillard et al. | |
| 3,798,845 A | | 3/1974 | Stevens | |
| 4,475,319 A | | 10/1984 | Wirz | |
| 4,571,891 A | * | 2/1986 | Donner | |
| 5,245,793 A | * | 9/1993 | Schmitz | |

FOREIGN PATENT DOCUMENTS

| | | | |
|---|---|---|---|
| DE | 28 34 157 | | 2/1979 |
| DE | 37 01 778 | | 8/1987 |
| DE | 37 19 989 | | 1/1988 |
| DE | 43 21 449 | | 1/1995 |
| DE | 196 19 401 | | 11/1997 |
| EP | 0 417 050 | | 3/1991 |
| JP | 59-156668 | * | 5/1984 |

* cited by examiner

*Primary Examiner*—Timothy V. Eley
(74) *Attorney, Agent, or Firm*—Collard & Roe, P.C.

(57) ABSTRACT

The description deals with a facility for dressing of a grindstone (1) for grinding of a running surface structure of a ski, which facility consists of a rotating drive (7) for the grindstone (1), of a dresser (2) adjustable to the circumferential surface of the grindstone (1) and equipped with at least one cutting insert, and of a feed drive (6) for the axially parallel relative movement of the dresser (2) against the grindstone (1). To create favorable construction features it is suggested to provide a controlling system (8) for the feed drive (6) and/or the rotating drive (7), equipped with a control program memory (9) selectable via an input unit (10) and with an evaluation circuit (12) connected to the control program memory (9) for the program-sensitive definition of the position-dependent switching points for the rate of the feed drive (6) and/or the rotating drive (7).

3 Claims, 1 Drawing Sheet

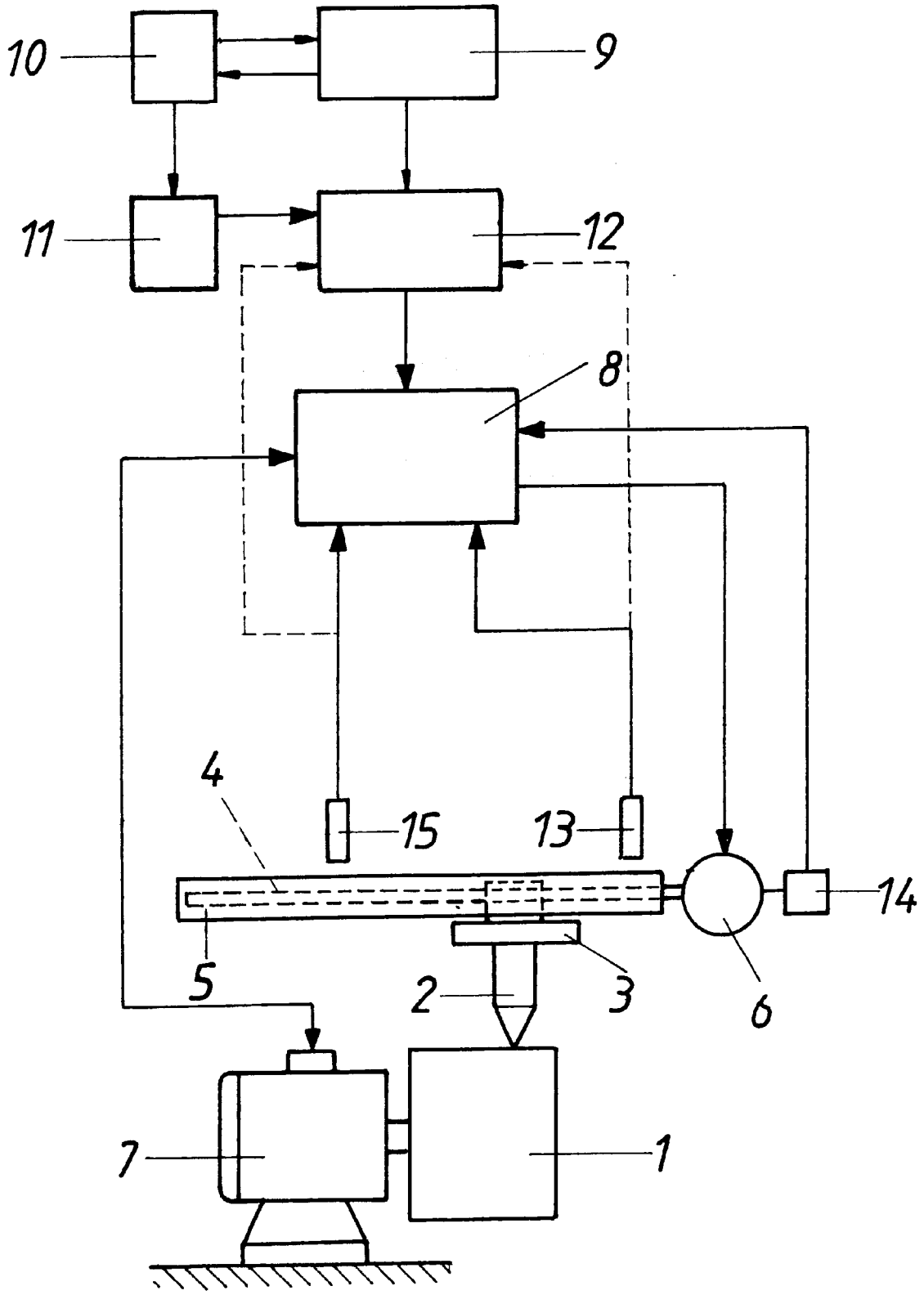
10
9
11
12
8
4
15
13
14
5
2
3
6
7
1

DEVICE FOR DRESSING A GRINDSTONE TO POLISH THE RUNNING SURFACE STRUCTURE OF A SKI

CROSS-REFERENCE TO RELATED APPLICATIONS

Applicants claim priority under 35 U.S.C. §119 of Austrian application No. A 52/98, filed on Jan. 16, 1998. Applicants also claim priority under 35 U.S.C. §120 of PCT/AT99/00009, filed on Jan. 12, 1999. The international application under PCT article 21(2) was not published in English.

FIELD OF INVENTION

The invention refers to a facility for dressing of a grindstone for grinding of a running surface structure of a ski, consisting of a rotating drive for the grindstone, of a dresser adjustable to the circumferential surface of the grindstone and equipped with at least one cutting insert, as well as of a feed drive for an axially parallel relative movement of the dresser against the grindstone.

DESCRIPTION OF THE PRIOR ART

In order to reduce friction between the running surface of a ski and the snow on the one hand, and to be able to influence the water film forming between the running surface and the snow, running surfaces of skis are structured. For this purpose various geometrical forms of running surface structures have been suggested, which are able to account for various conditions. To create the running surface structures formed by finely divided grooves of the running surface, stamping tools are used, which, however, do not permit any variation of the given structure. Moreover, the displaced material of the running surface coating forms edge beads that have to be removed in an additional working cycle, otherwise these beads will adversely affect the running qualities of the ski. Another factor is that the running surface structure produced by means of a stamping tool cannot be refined at will.

If a rotating grindstone is applied for machining the running surface of a ski, the circumferential surface of which is provided with screw thread undercuts running in opposite direction, the running surface of a ski can be ground to an appropriate structure by means of such a grindstone, which has the advantage that, apart from waxing or polishing of edges as required, any refinishing of the running surface becomes unnecessary. Moreover, the possible fineness of the running surface structure is limited only by the dresser for the grindstone, which consists of at least one cutting insert in the form of a true diamond projecting towards the circumferencial surface of the grindstone. For dressing of the grindstone, the dresser is to be moved axially parallel against the rotating grindstone, with the relative axial rate of feed of the dresser against the grindstone, together with the speed of the grindstone, determining the pitch of the screw thread undercut cut into the circumferential surface of the grindstone by means of the cutting insert. Via this pitch of the screw thread undercut, the fineness of the grindstone structure and thus the fineness of the structure of a running surface of a ski machined by means of such a grindstone can be determined. By means of the known dressing devices for grindstones for grinding of running surfaces of skis, essentially, it is only possible to determine the fineness of the structure, but not a course of the structure favorably adapted to the respective requirements depending on different influencing variables like type of snow, snow temperature, type of coating of running surfaces, type of ski or skill of running of the user of the ski.

SUMMARY OF THE INVENTION

Therefore, the invention has the task to design a facility for dressing of a grindstone for grinding of a running surface structure of a ski of the above mentioned type in such a way, that grindstones for the production of manifold shapes and finenesses of structure can be dressed quickly and reproducibly to allow for the relevant given influencing variables.

The invention solves the task by providing a controlling system for the feed drive and/or the rotating drive, which controlling system is provided with a control program memory selectable via an input unit and with an evaluation circuit connected to the control program memory for program-sensitive definition of position-related switching points for the rate of the feed drive and/or the rotating drive.

The invention is based on the finding that the webs remaining between the intersecting screw thread undercuts running in opposite direction, the horizontal view of which is rhomboidal, form rows stretching transverse to the sense of rotation of the grindstone, and including an angle with the sense of rotation that depends on the ratio of pitches of the intersecting screw thread undercuts. In case of corresponding pitches of the intersecting screw thread undercuts, the rows of the rhomboidal webs run vertical to the sense of rotation. In case of different pitches there is a corresponding gradient of these rhomboidal rows, depending on the pitch difference, which results in a correspondingly inclined course of the running surface structure against the longitudinal axis of the ski. If the pitches of the screw thread undercuts in the circumferential surface of the grindstone in the area of axial sections of the grindstone are varied, web rows of different gradients—at least in some sections—against the sense of rotation will result, with the effect that a running surface of a ski finished by means of such a grindstone, too, shows a structure with an inclined course varying over the width of the running surface. As this course of gradient of the structure sections repeating over the length of the ski is effective mainly on the formation of a water film between the running surface of the ski and the snow, the favorable gradient of the repeating structure sections of the running surface causes a good lateral displacement of water. For this purpose a control program memory is allocated to the controlling system for the feed drive and/or rotating drive, determining the pitch of the respective screw thread undercut, in which control program memory various control programs for given structural shapes of a running surface of a ski are stored, so that only the control program stored for a certain running surface structure must be selected via the input unit in order to preset the switching points for the rate of the feed drive and/or the rotating drive via the evaluation circuit, connected to the program memory, of the controlling system. These switching points are calculated by the program and determine, as a function of the axial position, the variation of the pitch of the screw thread undercut, which is cut into the circumferential surface of the grindstone by means of the true diamond. If, for example, the relative rate of feed of the dresser against the grindstone during cutting of the screw thread undercuts running in opposite direction is reduced by a given amount at the longitudinal center of the grindstone with the initial speed remaining constant, this will result in a V-shaped course of the rows of the rhomboidal webs between the intersecting screw thread undercuts. The gradient of the V-sides of these rows can be varied via the appropriate rate settings, while on no account implying symmetrical conditions. Additionally, the variation of the gradient of the structures may be shifted from the axial longitudinal center of the grindstone to allow for particularly asymmetrial conditions for the displacement of the water film between the running surface and the snow, as this may be favorable, for instance, for cross-country skis, where, compared with alpine skis, there are particular, asymmetrical load conditions because of the skating technique. Of course, it is also possible for the pitch of the screw thread undercuts to vary steadily along with the angle of rotation, if required, for instance to be able to grind a wavy structure into the running surface.

If the evaluation curcuit is connected to a program data memory for characteristic data for the control program to be selected via the input unit as a function of the respective control program selected, control can be easily influenced via the presetting of characteristic data, so that the control program can be adapted to the desired requirements in each case. For example, via these characteristic data the gradient conditions of the sections of the running surface structure repeating over the length of the ski, the fineness of the running surface structure or a possible lateral displacement of the selected structure can be preset. These characteristic data inquired by the program and input via the input unit are then preset via the program data memory of the evluation circuit to define the rate and the position-dependent switching points for the rate of the feed drive and/or the rotating drive. As the only important factor is the relevant pitch of the screw thread undercuts cut into the circumferential surface of the grindstone, these pitches may be controlled either via the feed drive or the rotating drive. But, of course, control via both the feed and the rotating drive is possible, too.

Since, in case of different pitches of the screw thread undercuts, the variation of the thread pitches must be determined in axial direction, an allocation of position between the dresser and the grindstone is necessary. This allocation of position can be easily achieved by constructional means in such a way that the controlling system is connected to position switches for the feed drive, arranged according to the axial length of the grindstone. Via these position switches, preset actual positions for the feed drive are transmitted to the controlling system, between which the feed control can be effected at sufficient accuracy without any addtional position control. Of course, an additional position control is possible, too.

BRIEF DESCRIPTION OF THE DRAWING

The drawing depicts an example of the subject matter of the invention, i.e. the facility for dressing of a grindstone for grinding of a running surface structure of a ski according to the invention is depicted in a schematic block diagram.

DESCRIPTION OF THE PREFERRED EMBODIMENTS

According to the depicted example of embodiment, the grindstone to be dressed 1 is borne stationary, while the dresser 2 is provided on a carriage 3 displaceable parallel to the rotating axis of the grindstone 1. The carriage 3 is moved via a threaded spindle 4 along the carriage guide 5 by means of a feed drive 6, which is designed as an electric motor. The grindstone 1 is driven by a rotating drive 7, which, like the feed drive 6, is controlled by means of a controlling system 8. The feed drive 6 and the rotating drive 7 can be controlled via various control porgrams stored in a control program memory 9 and selected via an input unit 10. The boundary conditions of the individual control programs are defined via characteristic data preset via the input unit 10, in order to be able to adapt the selected control program according to the relevant requirements. Via the input unit 10, the characteristic data to be preset are read into the program data memory 11, which provides these characteristic data to an evaluation circuit 12, which calculates the reference variables for controlling the feed drive 6 and/or the rotating drive 7 and applies these reference variables to the controlling system 8. Thus, via the evaluation circuit 12, the relevant rates for the feed drive 6 and/or the rotating drive 7, as well as the position-dependent switching points for any preset changes of rate are defined by the programm. Therefore, the grindstone 1 can be machined according to these specifications by means of the dresser 2. Via a position switch 13 for the tool carriage 3, the starting position for adjustment of the dresser 2 is recorded, the cutting insert of which, preferably a true diamond or a ceramic material, cuts a screw thread undercut into the circumferential surface of the grindstone 1. The pitch of this screw thread undercut depends on the rate of feed of the dresser 2 and the speed of the rotating drive 7 for the grindstone 1. To achieve a certain pitch of the screw thread undercut, these rates are preset via the controlling system 8, as a function of the selected control program and the selected boundary conditions. If program-sensitive variations of the pitch of the screw thread undercut are intended, the rate of feed of the carriage 3, for example, is changed, as soon as the switching point preset in the controlling system 8 is reached. The axial position of the carriage 3 is then recorded via a rotary step transducer 14 of the feed drive 6. The counter content of a counter connected to the rotary step transducer 14, which is set ot a preset counter content via the position switch 13, indicates the axial position of the carriage 3, so that the position-dependent switching points for the rate of the feed drive 6 can be easily controlled via this position detection system. The feed drive 6 is switched off after the program-sensitive changes of rate at the end of the feed travel monitored via the position switch 15, which resets the counter of the rotary steps back to a preset number to make up for possible errors. After reversing the feed direction, a second screw thread undercut running in opposite direction is cut into the circumferential surface of the grindstone 1, as a function of the already cut screw thread undercut, to provide the circumferential surface of the grindstone 1 with a given structure of adjacent rhomboidal webs. The switching points for the change of the rate of feed, again, are effected via the controlling system 8, which is responsible for a program-sensitive dressing of the grindstone 1, so that by means of this grindstone 1 a running surface of a ski with selected structure can be ground.

Of course, the invention is not confined to the depicted example of embodiment. For example, the grindstone 1 might be moved via a carriage opposite the stationary dresser 2 by means of its rotating drive 7, as the only important factor for cutting a screw thread undercut into the rotating grindstone 1 is the axial relative movement of the dresser 2 against the grindstone 1. Moreover, the dresser might be equipped with a controlled adjusting drive, so that an additional design possibility for the running surface structure to be ground is achieved via the depth of the screw thread undercuts. Apart from that, the position switches 13, 15 might also be assigned with the evaluation circuit 12, as this is outlined in the drawing in short dashes. In this case, the relevant end positions of the position control of the carriage 3 of the controlling system 8 are preset via the evaluation circuit 8. Moreover, the cutting insert of the dresser 2 might be aligned against the screw thread undercut to be cut by means of an additional actuator to ensure additional effects. The grindstone may also be subjected to oscillating movement during grinding.

Finally, it shall be stated that grindstones 1 might be dressed in the same kind for different types of skis. In this case, of course, the running surface structure to be selected for the relevant type of ski must be considered, as there are different requirements, for example, for alpine skis, than there are for snowboards, cross-country skis or jumping skis.

What is claimed is:

1. Facility for dressing a grindstone for grinding a running surface structure of a ski, the grindstone having a circumferential surface comprising a rotating drive for the grindstone, a dresser adjustable to the circumferential surface of the grindstone and equipped with at least one cutting insert, a feed drive for moving the dresser axially parallel relative to the grindstone, and a controlling system for the feed drive and/or the rotating drive with a memory of a central program selectable via an input unit and with an evaluation circuit connected to the control program memory for a program-sensitive definition of position-dependent switching points for the rate of the feed drive and/or the rotating drive.

2. Facility according to claim 1, wherein the evaluation circuit is connected to a program data memory for characteristic data for the control program, to be preset as a function of a relevant selected control program via the input unit.

3. Facility according to claim 1, wherein the controlling system is connected to position switches for the feed drive arranged along the axial length of the grindstone.

* * * * *